US012429298B2

(12) United States Patent
DeSomma

(10) Patent No.: US 12,429,298 B2
(45) Date of Patent: Sep. 30, 2025

(54) REDUCED WEIGHT FIREARM

(71) Applicant: Patriot Ordnance Factory, Inc., Phoenix, AZ (US)

(72) Inventor: Frank L. DeSomma, Glendale, AZ (US)

(73) Assignee: PATRIOT ORDANCE FACTORY, Phoenix, AZ (US)

( * ) Notice: Subject to any disclaimer, the term of this patent is extended or adjusted under 35 U.S.C. 154(b) by 0 days.

(21) Appl. No.: 17/868,670

(22) Filed: Jul. 19, 2022

(65) Prior Publication Data

US 2022/0373286 A1 Nov. 24, 2022

Related U.S. Application Data

(63) Continuation of application No. 16/990,955, filed on Aug. 11, 2020, now Pat. No. 11,391,531, which is a continuation of application No. 16/160,497, filed on Oct. 15, 2018, now Pat. No. 10,739,096, which is a continuation of application No. 15/410,534, filed on Jan. 19, 2017, now Pat. No. 10,132,587.

(60) Provisional application No. 62/280,690, filed on Jan. 19, 2016.

(51) Int. Cl.

| | |
|---|---|
| ***F41A 21/10*** | (2006.01) |
| ***F41A 3/16*** | (2006.01) |
| ***F41A 3/26*** | (2006.01) |
| ***F41A 15/12*** | (2006.01) |
| ***F41A 21/48*** | (2006.01) |
| *F41C 7/00* | (2006.01) |

(52) U.S. Cl.

CPC ..... *F41A 21/10* (2013.01); *F41A 3/16* (2013.01); *F41A 3/26* (2013.01); *F41A 15/12* (2013.01); *F41A 21/48* (2013.01); *F41C 7/00* (2013.01)

(58) Field of Classification Search

CPC .. F41A 21/10; F41A 3/16; F41A 21/48; F41C 7/00

USPC ..... 42/76.01

See application file for complete search history.

(56) References Cited

U.S. PATENT DOCUMENTS

| | | | |
|---|---|---|---|
| 1,290,853 | A | 1/1919 | Sturgeon |
| 1,352,414 | A | 9/1920 | Oscar, V |
| 1,357,208 | A | 10/1920 | Oscar, V |
| 1,402,459 | A | 1/1922 | Gustaf |
| 1,738,501 | A | 12/1929 | Moore |
| 1,789,835 | A | 1/1931 | Pedersen |
| 1,879,603 | A | 9/1932 | Coupland |
| 1,912,757 | A | 6/1933 | Brump |

(Continued)

OTHER PUBLICATIONS

USPTO; Restriction Requirement dated Jul. 25, 2007 in U.S. Appl. No. 11/056,306.

(Continued)

*Primary Examiner* — Samir Abdosh
(74) *Attorney, Agent, or Firm* — KW Law, LLP

(57) ABSTRACT

A rotating bolt firearm may be configured to fire a .308 cartridge. However, the firearm may have a reduced weight in comparison to standard .308 rifles. The firearm may have many components typically used in a .223 rifle. The firearm may include a barrel extension with an extractor gap, which allows a .308 bolt to fit within a .223 sized barrel extension. The firearm may comprise an elongated magazine well in comparison to a .223 mil-spec rifle. The firearm may weigh less than 6.8 pounds with a 16-inch barrel, or less than 6.3 pounds with a 10.5 inch barrel.

21 Claims, 8 Drawing Sheets

(56) References Cited

U.S. PATENT DOCUMENTS 2,102,622 A 12/1937 Green
2,110,165 A 3/1938 Moore
2,116,141 A 5/1938 Browning
2,124,075 A 7/1938 Moore
2,287,066 A 6/1942 Rogers
2,391,864 A 1/1946 Chandler
2,437,548 A 3/1948 Patchett
2,467,372 A 4/1949 Permentier
2,482,880 A 9/1949 Sefried
2,570,292 A 10/1951 Umsted
2,816,484 A 12/1957 Grages
2,935,912 A 5/1960 Hartley
3,051,057 A 8/1962 Ivy
3,071,225 A 1/1963 Blau
3,118,243 A 1/1964 Manshel
3,301,133 A 1/1967 Sturtevant
3,455,204 A 7/1969 Stoner
3,675,534 A 7/1972 Beretta
3,724,325 A 4/1973 Silsby
3,736,693 A 6/1973 Koch
3,908,214 A 9/1975 Doloreto
3,943,821 A 3/1976 Seifried
4,057,924 A 11/1977 Joseph
4,244,273 A 1/1981 Langendorfer, Jr.
4,246,830 A 1/1981 Krieger
4,521,985 A 6/1985 Smith
4,536,982 A 8/1985 Bredbury
4,576,083 A 3/1986 Seberger, Jr.
D285,236 S 8/1986 Brunton
4,651,455 A 3/1987 Geiser, Jr.
4,658,702 A 4/1987 Tatro
4,663,875 A 5/1987 Tatro
4,759,144 A 7/1988 Egan
4,765,224 A 8/1988 Morris
4,937,964 A 7/1990 Crandall
D329,078 S 9/1992 Hasselbush
5,183,959 A 2/1993 McCoan
5,272,956 A 12/1993 Hudson
5,343,650 A 9/1994 Swan
5,351,598 A 10/1994 Schuetz
5,386,659 A 2/1995 Vaid
5,479,737 A 1/1996 Osborne
5,543,787 A 8/1996 Karidis
5,551,179 A 9/1996 Young
5,590,484 A 1/1997 Mooney
5,634,288 A 6/1997 Martel
5,726,377 A 3/1998 Harris
5,770,814 A 6/1998 Ealovega
D399,914 S 10/1998 Walker
5,827,992 A 10/1998 Harris
5,930,935 A 8/1999 Griffin
5,983,774 A 11/1999 Mihaita
6,070,352 A 6/2000 Daigle
6,113,285 A 9/2000 Ward
6,209,250 B1 4/2001 Mills
6,217,205 B1 4/2001 Ward
D447,791 S 9/2001 Robidoux
6,308,448 B1 10/2001 Kapusta
6,345,460 B2 2/2002 Hashman
6,347,474 B1 2/2002 Wolff, Jr.
D462,105 S 8/2002 Myers
6,470,615 B1 10/2002 Peterken
6,490,822 B1 12/2002 Swan
6,508,027 B1 1/2003 Kim
6,508,159 B1 1/2003 Muirhead
D477,855 S 7/2003 Selvaggio
6,606,812 B1 8/2003 Gwinn, Jr.
6,634,274 B1 10/2003 Herring
6,681,677 B2 1/2004 Herring
6,694,660 B1 2/2004 Davies
6,722,072 B1 4/2004 McCormick
6,722,255 B2 4/2004 Herring
6,779,288 B1 8/2004 Kim
6,827,130 B2 12/2004 Larson
6,839,998 B1 1/2005 Armstrong
6,848,351 B1 2/2005 Davies
6,854,206 B2 2/2005 Oz
D504,168 S 4/2005 McCormick
6,921,181 B2 7/2005 Yen
6,971,202 B2 12/2005 Bender
7,051,467 B1 5/2006 Huber
7,131,228 B2 11/2006 Hochstrate
D544,063 S 6/2007 Swan
7,313,883 B2 * 1/2008 Leitner-Wise ..... F41A 21/484 42/75.02
7,316,091 B1 1/2008 DeSomma
7,363,741 B2 4/2008 DeSomma
7,418,898 B1 9/2008 DeSomma
7,421,937 B1 9/2008 Gangl
7,464,496 B1 12/2008 Davies
D590,473 S 4/2009 Fitzpatrick
D593,617 S 6/2009 Dochterman
7,584,567 B1 9/2009 DeSomma
7,600,338 B2 10/2009 Geissele
D604,793 S 11/2009 Fitzpatrick
7,753,679 B1 7/2010 Schuetz
7,784,211 B1 8/2010 DeSomma
D624,609 S 9/2010 Stein
7,798,045 B1 9/2010 Fitzpatrick
7,827,722 B1 11/2010 Davies
D629,062 S 12/2010 Peterson
7,856,917 B2 12/2010 Noveske
D630,698 S 1/2011 Peterson
D631,933 S 2/2011 Thompson
7,891,284 B1 2/2011 Barrett
7,905,041 B1 3/2011 Davies
7,930,968 B2 4/2011 Giefing
D643,086 S 8/2011 Peterson
D645,532 S 9/2011 Peterson
8,056,460 B2 11/2011 Herring
8,091,265 B1 1/2012 Teetzel
8,161,864 B1 4/2012 Vuksanovich
8,230,634 B1 7/2012 Davies
8,261,653 B2 9/2012 Crommett
8,359,966 B1 1/2013 Brotherton
8,375,616 B2 2/2013 Gomez
8,381,628 B1 2/2013 Wheatley
8,479,428 B1 7/2013 DeSomma
D708,693 S 7/2014 Faxon
D713,483 S 9/2014 Firpo
8,826,797 B2 9/2014 Overstreet
8,844,424 B2 9/2014 Gomez
D716,404 S 10/2014 Capps
8,863,637 B2 10/2014 Hall
8,869,674 B2 10/2014 Ruck
D717,904 S 11/2014 Oglesby
8,875,614 B2 11/2014 Gomez
D720,032 S 12/2014 Boutin
8,910,406 B1 12/2014 Huang
8,978,282 B2 3/2015 Garrett
9,032,860 B2 5/2015 Faxon
D741,978 S 10/2015 Shea
9,194,638 B2 11/2015 Larson, Jr.
D745,621 S 12/2015 Huang
D748,754 S 2/2016 Chastain
D750,725 S 3/2016 Capps
9,291,412 B1 3/2016 Montes
9,303,949 B1 4/2016 Oglesby
D755,339 S 5/2016 Geissele
D757,199 S 5/2016 Bender
D760,860 S 7/2016 Vincent
D763,397 S 8/2016 Huang
D764,004 S 8/2016 Bender
9,423,194 B2 8/2016 Fritz
9,429,375 B2 8/2016 DeSomma
9,448,020 B1 * 9/2016 Olson ..... F41A 3/66
D768,801 S 10/2016 Morris
D771,767 S 11/2016 Niswander
9,523,557 B2 12/2016 Sharron
9,523,558 B2 12/2016 Visinski
9,528,793 B1 12/2016 Oglesby
D777,285 S 1/2017 Bender
9,593,897 B2 * 3/2017 Larson, Jr. ..... F41A 9/55
10,012,462 B2 7/2018 DeSomma

(56) References Cited

U.S. PATENT DOCUMENTS

| | | | | |
|---|---|---|---|---|
| 10,132,587 | B2 * | 11/2018 | DeSomma | F41A 3/16 |
| 2003/0010186 | A1 | 1/2003 | Muirhead | |
| 2003/0010187 | A1 | 1/2003 | Muirhead | |
| 2004/0064994 | A1 | 4/2004 | Luke | |
| 2004/0226212 | A1 | 11/2004 | Shiloni | |
| 2005/0000142 | A1 | 1/2005 | Kim | |
| 2005/0223613 | A1 | 10/2005 | Bender | |
| 2005/0241211 | A1 | 11/2005 | Swan | |
| 2005/0262752 | A1 | 12/2005 | Robinson | |
| 2005/0262997 | A1 | 12/2005 | Brixius | |
| 2006/0010748 | A1 | 1/2006 | Stoner | |
| 2006/0026883 | A1 | 2/2006 | Hochstrate | |
| 2006/0236582 | A1 | 10/2006 | Lewis | |
| 2006/0265925 | A1 | 11/2006 | Murello | |
| 2006/0265926 | A1 | 11/2006 | Sietsema | |
| 2006/0277810 | A1 | 12/2006 | Leitner-Wise | |
| 2007/0006509 | A1 | 1/2007 | DeSomma | |
| 2007/0033851 | A1 | 2/2007 | Hochstrate | |
| 2007/0051236 | A1 | 3/2007 | Groves | |
| 2007/0079539 | A1 | 4/2007 | Karagias | |
| 2007/0169393 | A1 | 7/2007 | Frost | |
| 2007/0180984 | A1 | 8/2007 | Huther | |
| 2007/0199435 | A1 | 8/2007 | Hochstrate | |
| 2008/0078284 | A1 | 4/2008 | Murello | |
| 2009/0223357 | A1 | 9/2009 | Herring | |
| 2009/0249672 | A1 | 10/2009 | Zedrosser | |
| 2009/0313873 | A1 | 12/2009 | Roth | |
| 2010/0000400 | A1 | 1/2010 | Brown | |
| 2010/0251591 | A1 | 10/2010 | Burt | |
| 2010/0269682 | A1 * | 10/2010 | Vuksanovich | F41A 5/28 89/191.01 |
| 2010/0307042 | A1 * | 12/2010 | Jarboe | F41A 3/18 42/2 |
| 2010/0319231 | A1 | 12/2010 | Stone | |
| 2010/0319527 | A1 | 12/2010 | Giefing | |
| 2011/0000119 | A1 | 1/2011 | DeSomma | |
| 2011/0016762 | A1 | 1/2011 | Davies | |
| 2011/0056107 | A1 | 3/2011 | Underwood | |
| 2011/0214327 | A1 | 9/2011 | DeSomma | |
| 2011/0265638 | A1 * | 11/2011 | Overstreet | F41A 11/02 89/128 |
| 2011/0271827 | A1 | 11/2011 | Larson | |
| 2011/0283580 | A1 | 11/2011 | Esch | |
| 2012/0117845 | A1 | 5/2012 | DeSomma | |
| 2012/0167757 | A1 | 7/2012 | Gomez | |
| 2012/0174451 | A1 | 7/2012 | Overstreet | |
| 2012/0260793 | A1 | 10/2012 | Gomez | |
| 2012/0297656 | A1 | 11/2012 | Langevin | |
| 2012/0311908 | A1 * | 12/2012 | Kenney | F41A 21/482 42/75.02 |
| 2013/0098235 | A1 | 4/2013 | Reinken | |
| 2013/0174721 | A1 | 7/2013 | Langevin | |
| 2013/0219763 | A1 | 8/2013 | Nunes | |
| 2013/0220295 | A1 | 8/2013 | Wood | |
| 2013/0227869 | A1 | 9/2013 | Thordsen | |
| 2014/0000142 | A1 | 1/2014 | Patel | |
| 2014/0033590 | A1 * | 2/2014 | Gomez | F41A 21/48 42/75.02 |
| 2014/0060312 | A1 | 3/2014 | Ruck | |
| 2014/0075804 | A1 | 3/2014 | Langevin | |
| 2014/0076149 | A1 | 3/2014 | Adams | |
| 2014/0090283 | A1 | 4/2014 | Gomez | |
| 2014/0115938 | A1 * | 5/2014 | Jarboe | F41A 21/485 42/71.01 |
| 2014/0224114 | A1 | 8/2014 | Faxon | |
| 2014/0230297 | A1 * | 8/2014 | Larson, Jr. | F41A 19/11 42/6 |
| 2014/0260945 | A1 | 9/2014 | DeSomma | |
| 2014/0311007 | A1 | 10/2014 | Capps | |
| 2014/0352191 | A1 | 12/2014 | Fritz | |
| 2015/0007476 | A1 | 1/2015 | Dextraze | |
| 2015/0040455 | A1 | 2/2015 | Lewis | |
| 2015/0168092 | A1 * | 6/2015 | Stone | F41A 21/481 42/76.01 |
| 2015/0198409 | A1 | 7/2015 | DeSomma | |
| 2015/0226501 | A1 | 8/2015 | Gibbens | |
| 2015/0253091 | A1 | 9/2015 | Gardner | |
| 2015/0323269 | A1 | 11/2015 | McGinty | |
| 2015/0330730 | A1 * | 11/2015 | Stone | F41C 23/18 89/33.01 |
| 2015/0330733 | A1 | 11/2015 | DeSomma | |
| 2015/0345879 | A1 | 12/2015 | Jen | |
| 2015/0362270 | A1 | 12/2015 | Stewart | |
| 2015/0369558 | A1 | 12/2015 | Gottzmann | |
| 2016/0003326 | A1 | 1/2016 | Park | |
| 2016/0033226 | A1 * | 2/2016 | Potter | F41A 3/30 42/76.01 |
| 2016/0178297 | A1 | 6/2016 | Sharps | |
| 2016/0209137 | A1 | 7/2016 | DeSomma | |
| 2016/0209138 | A1 | 7/2016 | DeSomma | |
| 2017/0051989 | A1 | 2/2017 | DeSomma | |
| 2017/0108303 | A1 * | 4/2017 | Gomez | F41A 5/26 |
| 2017/0153075 | A1 | 6/2017 | DeSomma | |
| 2017/0307321 | A1 * | 10/2017 | DeSomma | F41A 3/26 |

OTHER PUBLICATIONS

USPTO; Non-Final Office Action dated Oct. 10, 2007 in U.S. Appl. No. 11/056,306.

USPTO; Notice of Allowance dated May 9, 2008 in U.S. Appl. No. 11/056,306.

USPTO; Restriction Requirement dated Nov. 15, 2006 in U.S. Appl. No. 11/174,270.

USPTO; Non-Final Office Action dated Mar. 15, 2007 in U.S. Appl. No. 11/174,270.

USPTO; Final Office Action dated Sep. 26, 2007 in U.S. Appl. No. 11/174,270.

USPTO; Notice of Allowance dated Jan. 14, 2008 in U.S. Appl. No. 11/174,270.

USPTO; Non-Final Office Action dated Jan. 18, 2007 in U.S. Appl. No. 11/232,521.

USPTO; Final Office Action dated Jun. 15, 2007 in U.S. Appl. No. 11/232,521.

USPTO; Notice of Allowance dated Aug. 15, 2007 in U.S. Appl. No. 11/232,521.

USPTO; Non-Final Office Action dated Apr. 29, 2008 in U.S. Appl. No. 11/442,035.

USPTO; Notice of Allowance dated Sep. 30, 2008 in U.S. Appl. No. 11/442,035.

USPTO; Non-Final Office Action dated Dec. 27, 2007 in U.S. Appl. No. 11/527,851.

USPTO; Final Office Action dated Aug. 13, 2008 in U.S. Appl. No. 11/527,851.

USPTO; Non-Final Office Action dated Mar. 3, 2009 in U.S. Appl. No. 11/527,851.

USPTO; Final Office Action dated Sep. 1, 2009 in U.S. Appl. No. 11/527,851.

USPTO; Notice of Allowance dated Mar. 29, 2013 in U.S. Appl. No. 11/527,851.

USPTO; Non-Final Office Action dated Dec. 14, 2009 in U.S. Appl. No. 11/947,294.

USPTO; Notice of Allowance dated May 5, 2010 in U.S. Appl. No. 11/947,294.

USPTO; Non-Final Office Action dated Dec. 11, 2008 in U.S. Appl. No. 12/110,304.

USPTO; Notice of Allowance dated May 29, 2009 in U.S. Appl. No. 12/110,304.

USPTO; Non-Final Office Action dated Nov. 24, 2010 in U.S. Appl. No. 12/489,592.

USPTO; Notice of Allowance dated Mar. 3, 2011 in U.S. Appl. No. 12/489,592.

USPTO; Non-Final Office Action dated Feb. 17, 2013 in U.S. Appl. No. 12/497,048.

USPTO; Non-Final Office Action dated Feb. 15, 2012 in U.S. Appl. No. 13/098,196.

USPTO; Final Office Action dated Jun. 11, 2012 in U.S. Appl. No. 13/098,196.

(56) References Cited

OTHER PUBLICATIONS

USPTO; Non-Final Office Action dated Feb. 21, 2012 in U.S. Appl. No. 13/105,893.
USPTO; Final Office Action dated Apr. 13, 2012 in U.S. Appl. No. 13/105,893.
USPTO; Advisory Action dated Apr. 26, 2012 in U.S. Appl. No. 13/105,893.
USPTO; Notice of Allowance dated Jun. 22, 2012 in U.S. Appl. No. 13/105,893.
USPTO; Non-Final Office Action dated Feb. 15, 2012 in U.S. Appl. No. 13/358,347.
USPTO; Non-Final Office Action dated Jun. 6, 2012 in U.S. Appl. No. 13/358,347.
USPTO; Non-Final Office Action dated Feb. 27, 2013 in U.S. Appl. No. 13/708,025.
USPTO; Final Office Action dated Sep. 26, 2013 in U.S. Appl. No. 13/708,025.
USPTO; Non-Final Office Action dated Dec. 17, 2013 in U.S. Appl. No. 13/835,842.
USPTO; Final Office Action dated Jun. 4, 2014 in U.S. Appl. No. 13/835,842.
USPTO; Non-Final Office Action dated Oct. 24, 2014 in U.S. Appl. No. 13/835,842.
USPTO; Final Office Action dated Jun. 18, 2015 in U.S. Appl. No. 13/835,842.
USPTO; Non-Final Office Action dated Jan. 5, 2016 in U.S. Appl. No. 13/835,842.
USPTO; Final Office Action dated Jun. 1, 2016 in U.S. Appl. No. 13/835,842.
USPTO; Non-Final Office Action dated Jan. 29, 2015 in U.S. Appl. No. 14/216,733.
USPTO; Final Office Action dated Jul. 16, 2015 in U.S. Appl. No. 14/216,733.
USPTO; Non-Final Office Action dated Jan. 14, 2016 in U.S. Appl. No. 14/527,698.
USPTO; Notice of Allowance dated Apr. 25, 2016 in U.S. Appl. No. 14/527,698.
USPTO; Non-Final Office Action dated Aug. 17, 2015 in U.S. Appl. No. 14/596,018.
USPTO; Non-Final Office Action dated Jun. 23, 2016 in U.S. Appl. No. 15/002,096.
USPTO; Non-Final Office Action dated Jun. 22, 2016 in U.S. Appl. No. 15,002,382.
USPTO; Restriction Requirement dated Apr. 24, 2014 in U.S. Appl. No. 29/449,556.
USPTO; Notice of Allowance dated Jul. 7, 2014 in U.S. Appl. No. 29/449,556.
USPTO; Notice of Allowance dated Oct. 13, 2015 in U.S. Appl. No. 29/502,433.
USPTO; Non-Final Office Action dated Dec. 1, 2016 in U.S. Appl. No. 13/835,842.
USPTO; Final Office Action dated Dec. 27, 2016 in U.S. Appl. No. 15/002,096.
USPTO; Notice of Allowance dated Jan. 11, 2017 in U.S. Appl. No. 29/551,847.
USPTO; Restriction Requirement Office Action dated Jan. 27, 2017 in U.S. Appl. No. 15/002,382.
USPTO; Notice of Allowance dated Mar. 30, 2017 in U.S. Appl. No. 29/551,237.
USPTO; Non-Final Office Action dated Apr. 10, 2017 in U.S. Appl. No. 15/002,096.
USPTO; Final Office Action dated May 19, 2017 in U.S. Appl. No. 15/002,382.
USPTO; Non-Final Office Action dated Jun. 13, 2017 in U.S. Appl. No. 15/250,218.
USPTO; Final Office Action dated Jun. 28, 2017 in U.S. Appl. No. 13/835,842.
USPTO; Final Office Action dated Sep. 28, 2017 in U.S. Appl. No. 15/002,096.
USPTO; Restriction Requirement Office Action dated Oct. 31, 2017 in U.S. Appl. No. 15/410,534.
USPTO; Restriction Requirement Office Action dated Oct. 16, 2017 in U.S. Appl. No. 15/342,981.
USPTO; Office Action dated Jan. 9, 2018 in U.S. Appl. No. 13/835,842.
USPTO; Office Action dated Dec. 12, 2017 in U.S. Appl. No. 15/002,382.
USPTO; Office Action dated Jan. 18, 2018 in U.S. Appl. No. 15/410,534.
USPTO; Non-Final Office Action dated Feb. 1, 2018 in U.S. Appl. No. 15/342,981.
USPTO; Notice of Allowance dated Mar. 26, 2018 in U.S. Appl. No. 15/002,096.
USPTO; Notice of Allowance dated Mar. 29, 2018 in U.S. Appl. No. 15/250,218.
USPTO; Notice of Allowance dated Jul. 18, 2018 in U.S. Appl. No. 15/410,534.
USPTO; Final Office Action dated Aug. 27, 2018 in U.S. Appl. No. 13/835,842.
USPTO; Final Office Action dated Sep. 11, 2018 in U.S. Appl. No. 15/342,981.
USPTO; Notice of Allowance dated Sep. 20, 2018 in U.S. Appl. No. 15/002,382.
USPTO; Non-Final Office Action dated Sep. 28, 2018 in U.S. Appl. No. 16/025,593.
USPTO; Notice of Allowance dated Mar. 18, 2022 in U.S. Appl. No. 16/990,955.
USPTO; Non-Final Office Action dated Aug. 6, 2021 in U.S. Appl. No. 16/990,955.
USPTO; Notice of Allowance dated Apr. 3, 2020 in U.S. Appl. No. 16/160,497.
USPTO; Non-Final Office Action dated Nov. 21, 2019 in U.S. Appl. No. 16/160,497.
POF-USA Patriot Ordnance Factory, Inc., Upper Receiver web page, Retrieved from http://web.archive.org/web/20100922070336/http://www.pof- usa.com/upper/upperreceiver.html[Sep. 17, 2012 9:19:17 AM].
Rainer Arms Forged Mil-Spec Upper Minus FA 9mm / .22 LR, RainierArms.com, [online], [site visited Dec. 30, 2016]. URL: http://www.rainierarms.com/rainier-arms-forged-mil- spec-upper-minus-fa-22-Ir.
Rainer Arms Forged A4 Upper Receiver-GEN 2, RainierArms.com, [online], [site visited Dec. 30, 2016]. URL: http://www.rainierarms.com/rainier-arms-forged-A4-upper- receiver-gen2.
Rainer Arms Forged Mil-Spec Upper Minus Fa 1/LOGO, RainierArms.com, [online], [site visited Dec. 30, 2016]. URL: http://www.rainierarms.com/rainier-arms-forged-mil-spec- upper-minus-fa-w-logo.
BCM M4 Arms Upper Receiver Assembly, RainierArms.com, [online], [site visited Dec. 30, 2016]. URL: http://www.rainierarms.com/bcm-m4-upper-receiver-assembly.
NorthTech Defense Non Forward Assist ARIS Billet Upper Receiver, RainierArms.com, [online], [site visited Dec. 30, 2016]. URL: http://www.rainierarms.com/northtech- defense-non-forward-assist-arIS-billet-upper-receiver.
SAAAR 15 Stripped Flat Top Upper Receiever—No Mark, SurplusAmmo.com, [online], [site visited Dec. 30, 2016]. URL: http://www.surplusammo.com/saa-ar15-stripped-flat- top-upper-receiver-no-mark/.
"Aero Precision Assembled AR-15 Upper receiver with Port Door and Forward Assist, PrimaryArms.com, [online], [site visited Dec. 30, 2016]. URL: http://www.primaryarm s.com/ aero-precision-assembled-ar-15-upper-receiver-with- port-door-and-forward-assist-ap501603-asmbly ".
Anderson Manufacturing AR-15 Stripped Upper Receiver, PrimaryArms.com, [online], [site visited Dec. 30, 2016]. URL: http://www.primaryarms.com/anderson-manufacturing- ar-15-stripped-upper-receiver-ar-15-a3-upfor-um.
Vitor MUR Modular Upper Receiver with Shell Deflector Only Assembled AR-15 Matte, MidwayUSA.com, [online], [site visited

(56) References Cited

OTHER PUBLICATIONS

Dec. 30, 2016]. URL: http://www.midwayusa.com/product/478529/vitor-mur-modular-upper-receiver-with- shell-deflector-only-assembled-ar-15-matte.
LanTac USA LA00221 AR-15 UAR Stripped Upper Receiver 5.56mm Black, TombStoneTactical.com, [online], [site visited Dec. 13, 2016]. URL: http://www.tombstonetactical.com/catalog/lantac-USA/l a00221-arIS-uar-stripped- upper-receiver-5.56mm-black/.
"AR15-A3 Stripped Upper Receiver, FrederickArms.com, [online], [site visited Dec. 30, 2016]. URL:http://www.frederickarms.com/ar15-a3-stripped-upper- receiver.html ".
Upper Receiver AR-15, CrossHairCustoms.com, [online], [site visited Dec. 30, 2016]. URL: http://www.crosshaircustoms.com/product/ar-15-upper-receiver/.
"Always Armed, ""First AR Build (for myself that is)"", Mar. 23, 2014, MossbergOwn ers.com, http://mossergowners.com/forum/index.phpthreads/first-ar- build-for-myslef-that-is.11491/page-4 , Entire thread, Accessed Sep. 22, 2017."
Paulo_Santos, PWS POF Enhanced Buffer Tube Review, Feb. 9, 2011, Weapon Evolution, http://www.weaponevolution.com/forum/showthread. php3005-PWS-amp- POF-Enhanced-Buffer-Tube-Reviews , Entire thread, Accessed Sep. 22, 2017.

* cited by examiner

SECTION A-A

SECTION D-D

REDUCED WEIGHT FIREARM

CROSS-REFERENCE TO RELATED APPLICATIONS

This application is a continuation of U.S. Ser. No. 16/990,995 filed Aug. 11, 2020 and entitled "REDUCED WEIGHT FIREARM" that issued as U.S. Pat. No. 11,391,531 which is a continuation of U.S. Ser. No. 16/160,497 filed Oct. 15, 2018 and entitled "REDUCED WEIGHT FIREARM" that issued as U.S. Pat. No. 10,132,587, which is a continuation of U.S. Ser. No. 15/410,534 filed Jan. 19, 2017 and entitled "REDUCED WEIGHT FIREARM" that issued as U.S. Pat. No. 10,132,587, which claims priority to and the benefit of U.S. Provisional Application No. 62/280,690 filed on Jan. 19, 2016 and entitled "FIREARM," all of which are hereby incorporated by reference in their entirety for all purposes.

FIELD OF THE DISCLOSURE

The disclosure relates to devices, systems, and methods for providing a reduced weight firearm. More specifically, this disclosure provides devices, systems, and methods for reducing weight and increasing the operational efficiency of AR-15 style firearms.

BACKGROUND

Many firearm users prefer a .308 caliber rifle, as opposed to a .223 caliber rifle. However, the weight of a .308 caliber rifle is typically significantly greater than that of a .223 caliber rifle, which can offset some of the advantages of a .308 caliber rifle.

SUMMARY

An AR-15 style rifle may comprise an upper receiver assembly configured to fire a .308 caliber cartridge; and a lower receiver assembly, wherein the AR-15 style rifle has mil-spec controls.

In various embodiments, the rifle may comprise a .223 sized barrel extension. The rifle may have a weight of less than 6.8 pounds. The rifle may have a weight of less than 6.3 pounds.

A rotating bolt firearm may comprise an upper receiver; a lower receiver coupled to the upper receiver; a barrel coupled to the upper receiver; and a barrel extension coupled to the barrel, wherein the barrel extension comprises a first lug, a second lug, a third lug, a fourth lug, a fifth lug, a sixth lug, a seventh lug, and an extractor gap located between the first lug and the second lug.

In various embodiments, the first lug and the second lug may be separated by 90 degrees. The barrel extension may consist of seven lugs in total. The firearm may comprise an extractor configured to be located within the extractor gap. The extractor may comprise an extractor lug extending from a first side of the extractor, and wherein the extractor lug does not extend to a second side of the extractor. The barrel extension may be sized for a .223 caliber barrel. The rotating bolt firearm may be configured to fire a .308 cartridge. The firearm may comprise a magazine well, wherein the magazine well has an opening of at least 2.80 inches. The magazine well may be configured to receive a .308 cartridge. The barrel may comprise a length of 10.5 inches. A weight of the rotating bolt firearm may be less than 6.3 pounds. The magazine well may comprise a finger placement notch. The firearm may comprise grooves in a neck portion of a chamber of the barrel. The grooves may be configured to facilitate extraction of a cartridge.

DETAILED DESCRIPTION

The subject matter of the present disclosure is particularly pointed out and distinctly claimed in the concluding portion of the specification. A more complete understanding of the present disclosure, however, may be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

In the context of the present disclosure, devices, systems, and methods may find particular use in connection with rotating bolt firearms. However, various aspects of the disclosed embodiments may extend to all types of applications and to all types of firearms including, without limitation, automatic firearms, semi-automatic firearms, bolt action firearms, and/or the like. Similarly, the present disclosure may extend to firearms using any suitable action including, for example, rotating bolt firearms, and to any suitable actuation system including, for example, gas piston systems, gas impingement systems, manual actuation systems, and/or the like.

Figure 1A:
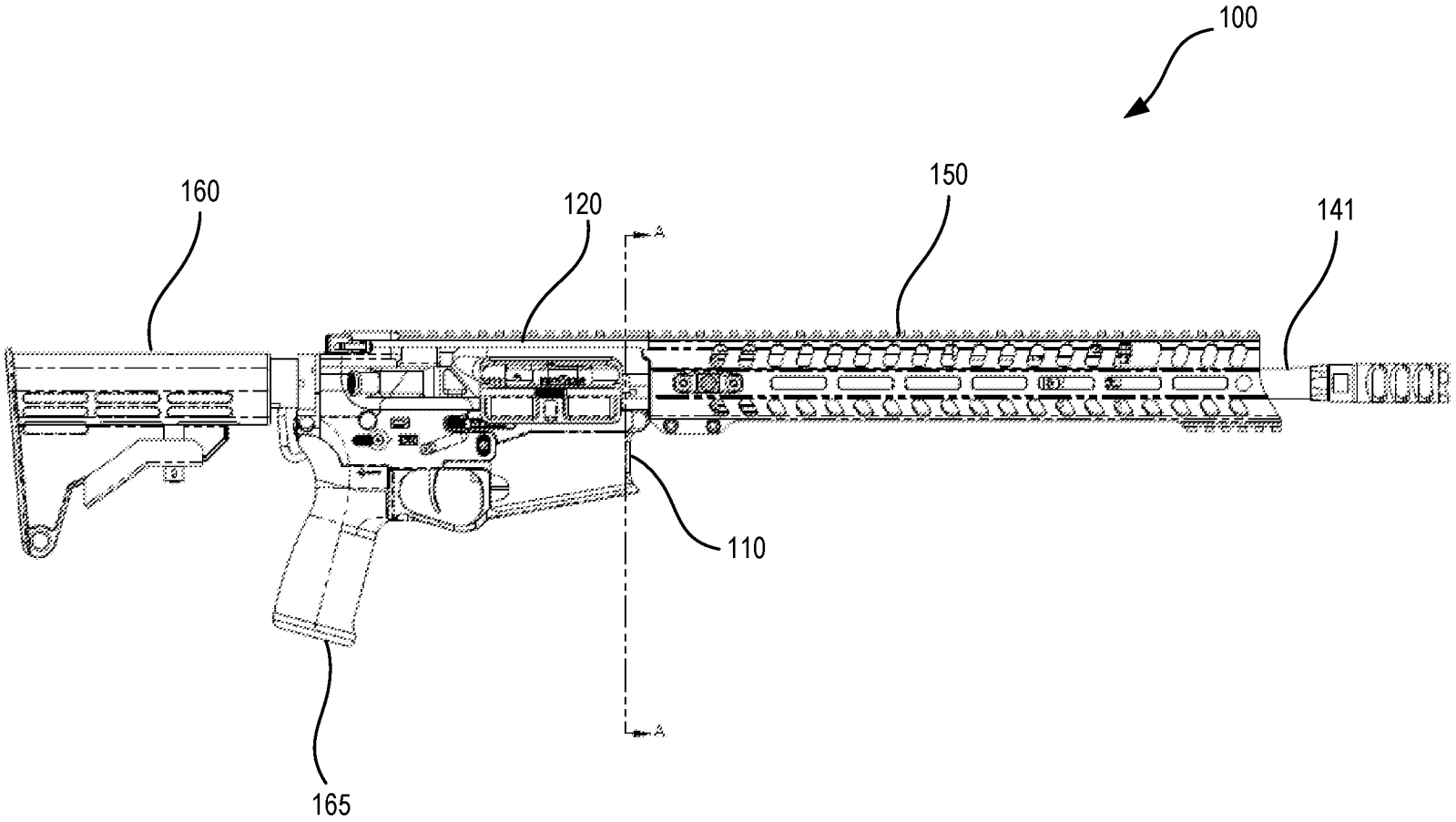
FIG. 1A illustrates a perspective view of a rifle in a battery position, in accordance with various embodiments.
Figure 1B:
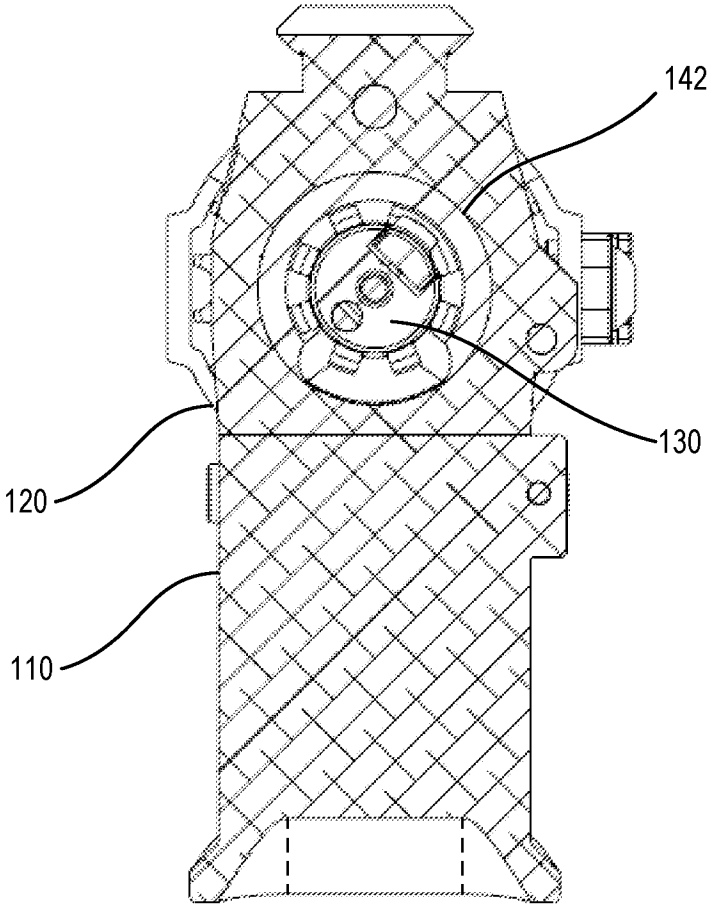
FIG. 1B illustrates a cross section view of the rifle, in accordance with various embodiments.
Figure 1C:
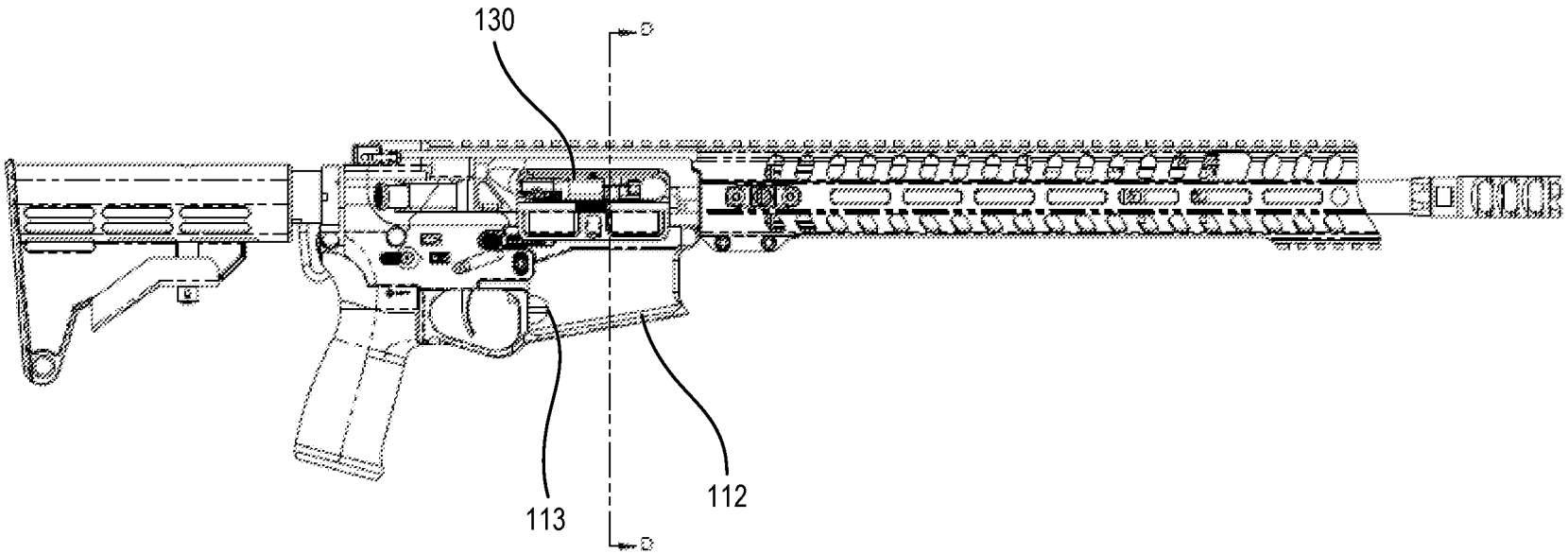
FIG. 1C illustrates a perspective view of the rifle in a partially out-of-battery position, in accordance with various embodiments.
Figure 1D:
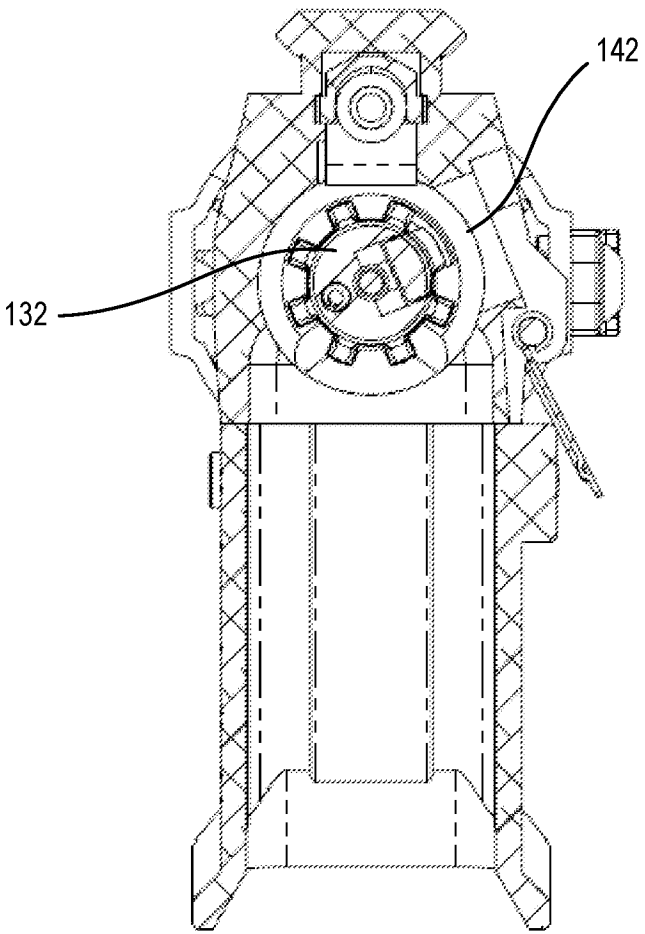
FIG. 1D illustrates a cross section view of the rifle through a magazine well, in accordance with various embodiments.

In various embodiments, and with reference to FIG. 1A through FIG. 1E, an AR 15 style rifle 100 is provided. Rifle 100 may be a rotating bolt rifle. Rifle 100 may comprise an upper receiver 120 and a lower receiver 110. Upper receiver 120 may be operatively coupled to a barrel 141 and/or barrel assembly and a rail system 150. Upper receiver 120 may also be coupled to or configured to receive a buttstock 160. Rifle 100 may be configured to fire a .308 caliber bullet. However, rifle 100 may be sized with weight and controls positioned at standard, or mil-spec locations in lower receiver 110 and/or upper receiver 120 for a .223 caliber rifle. For example, safety switches, selector switches, magazine release buttons, charging handles, and/or the like may be at positions that are found on a mil spec AR 15 style rifle configured to fire a 223 Remington and/or 5.56 NATO caliber cartridges (collectively, ".223 cartridge"). However, unlike the mil spec AR 15 style rifle, the selector switch head and the taken down pin head are arranged in an overlapping arrangement along an axis parallel two A-A, as shown in FIG. 1A. Stated another way, the axis may be perpendicular to the centerline of the barrel extension 142 and/or barrel 145 of firearm 100.

In various embodiments, rifle 100 may be configured to fire a .308 Winchester caliber bullet or cartridge (".308 cartridge"). A .308 cartridge may comprise a total length of 2.80 inches. Moreover lower receiver 110 of rifle 100 may be configured with a magazine well 112 that is appropriately sized to receive a .308 caliber magazine configured to deploy .308 caliber cartridges to upper receiver 120. Thus, the magazine well 112 may comprise a length of greater than 2.80 inches. In various embodiments, the magazine well 112 may comprise a finger placement notch 113. The finger placement notch 113 may be recessed into a side of the magazine well forward of the trigger guard, and may provide a functional location for a user to position a finger when not on the trigger.

In various embodiments, rifle 100 may weigh less than seven pounds fully assembled. For example, rifle 100 may be complete and operational and may include, for example, upper receiver 120, lower receiver 110, buttstock 160, handle 165, rail 150, barrel 141, and/or all other components including, for example a charging handle, a bolt assembly, a drop in trigger, and/or the like. In this regard the weight of a complete and operational rifle 100 in an unloaded configuration may be less than seven pounds. Moreover, the weight of a fully operational fully assembled rifle 100 may be less than six and half pounds period. In various embodiments, the barrel 141 may be 16 inches, and the weight of the rifle 100 may be less than 6.8 pounds. In various embodiments, the barrel 141 may be 10.5 inches, and the weight of the rifle 100 may be less than 6.3 pounds.

Figure 1E:
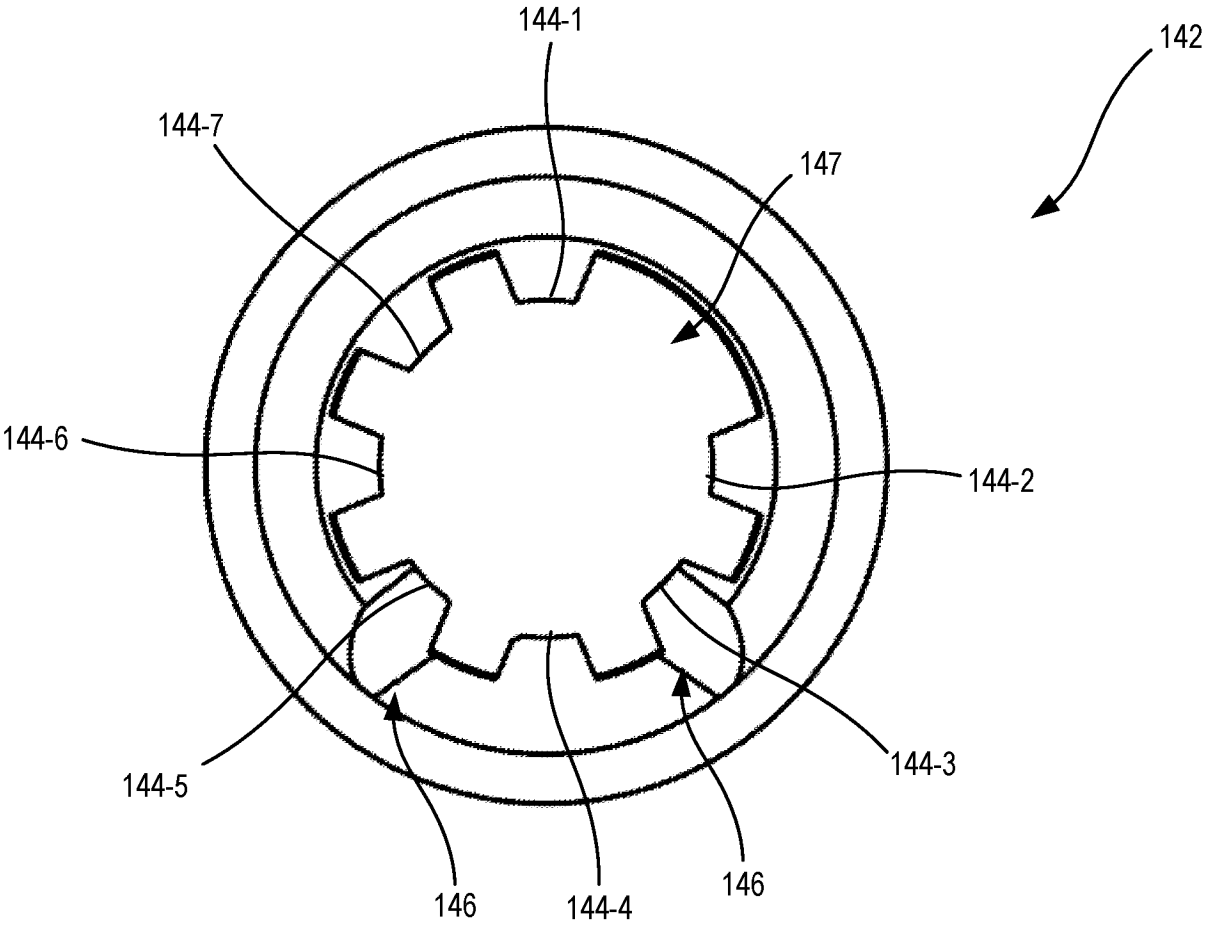
FIG. 1E illustrates a barrel extension, in accordance with various embodiments.

In various embodiments, a barrel extension 142 may be coupled to a barrel 141. Barrel extension 142 may be configured to receive a cartridge within upper receiver 120. In various embodiments, barrel extension 142 may be a .223 sized barrel extension and may be configured to receive a .308 cartridge as further explained below. A portion of barrel extension 142 may be located within the upper receiver 120. Moreover, barrel extension 142 may be configured to interface with a bolt face 132 of bolt 130 to provide for battery and out of battery configurations. Barrel extension 142 may comprise a plurality of lugs including, for example lug 144-1, lug 144-2, lug 144-3, lug 144-4, lug 144-5, lug 144-6, 144-7 as shown in FIG. 1E. Thus, the barrel extension 142 may comprise seven lugs. The lugs may be located at every 45 degree location around the interior circumference of the barrel extension, except for one. In the illustrated orientation, lug 144-1 may be located at zero degrees, lug 144-2 may be located at 90 degrees, lug 144-3 may be located at 135 degrees, lug 144-4 may be located at 180 degrees, lug 144-5 may be located at 225 degrees, lug 144-6 may be located at 270 degrees, and lug 144-7 may be located at 315 degrees.

Unlike mill spec or standard barrel extensions, barrel extension 142 may comprise an extractor gap 147. The extractor gap 147 may be a 90 degree portion of the barrel extension 142 without a lug. As illustrated the extractor gap 147 is located between adjacent lugs 144-1 and 144-2, which are separated by 90 degrees (minus the width of a lug). The extractor gap 147 may be formed by removing a lug from barrel extension 142, or by forming the barrel extension 142 without a lug in one of the eight locations typically including a lug in a mil spec barrel extension. Moreover extractor gap 147 may be sized substantially wide to accommodate an extractor capable of or configured to extract the case of a .308 caliber bullet from barrel extension 142. Barrel extension 142 may be configured with a feed ramp 146. The feed ramp 146 may be configured to contact a bullet tip as the bullet is being loaded into the chamber, and guide the bullet into the chamber.

Figure 2A:
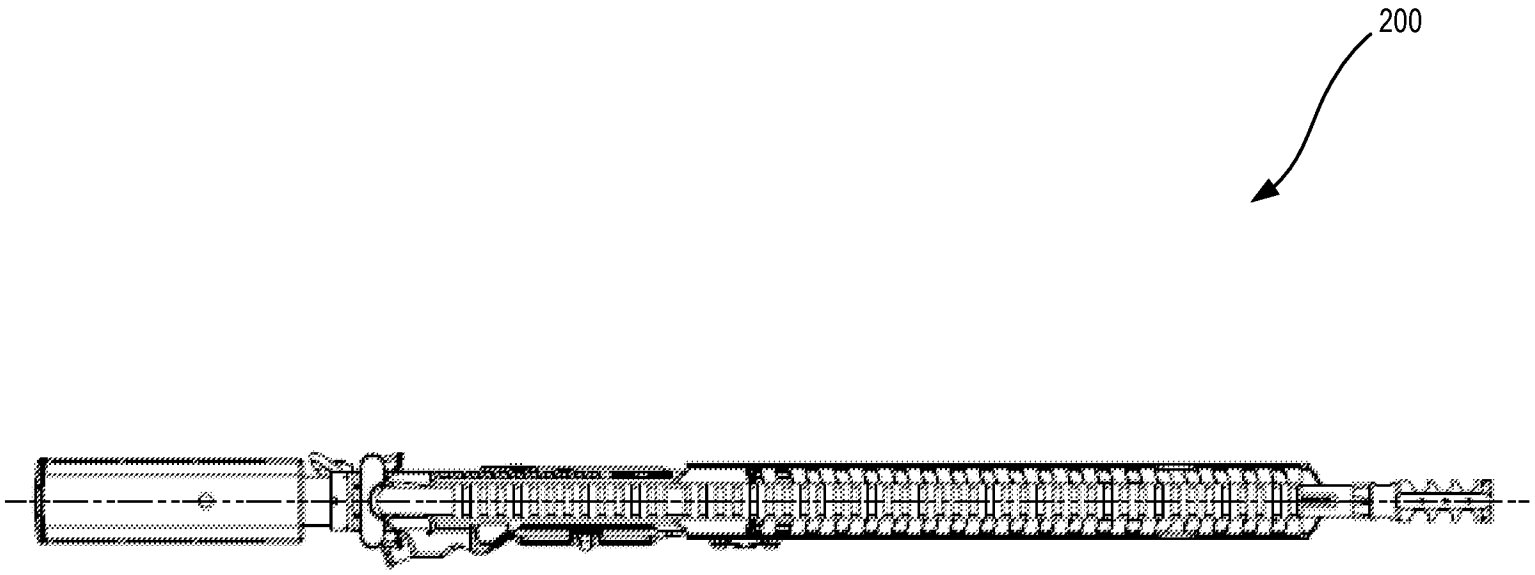
FIG. 2A illustrates a top view of a rifle, in accordance with various embodiments.
Figure 2B:
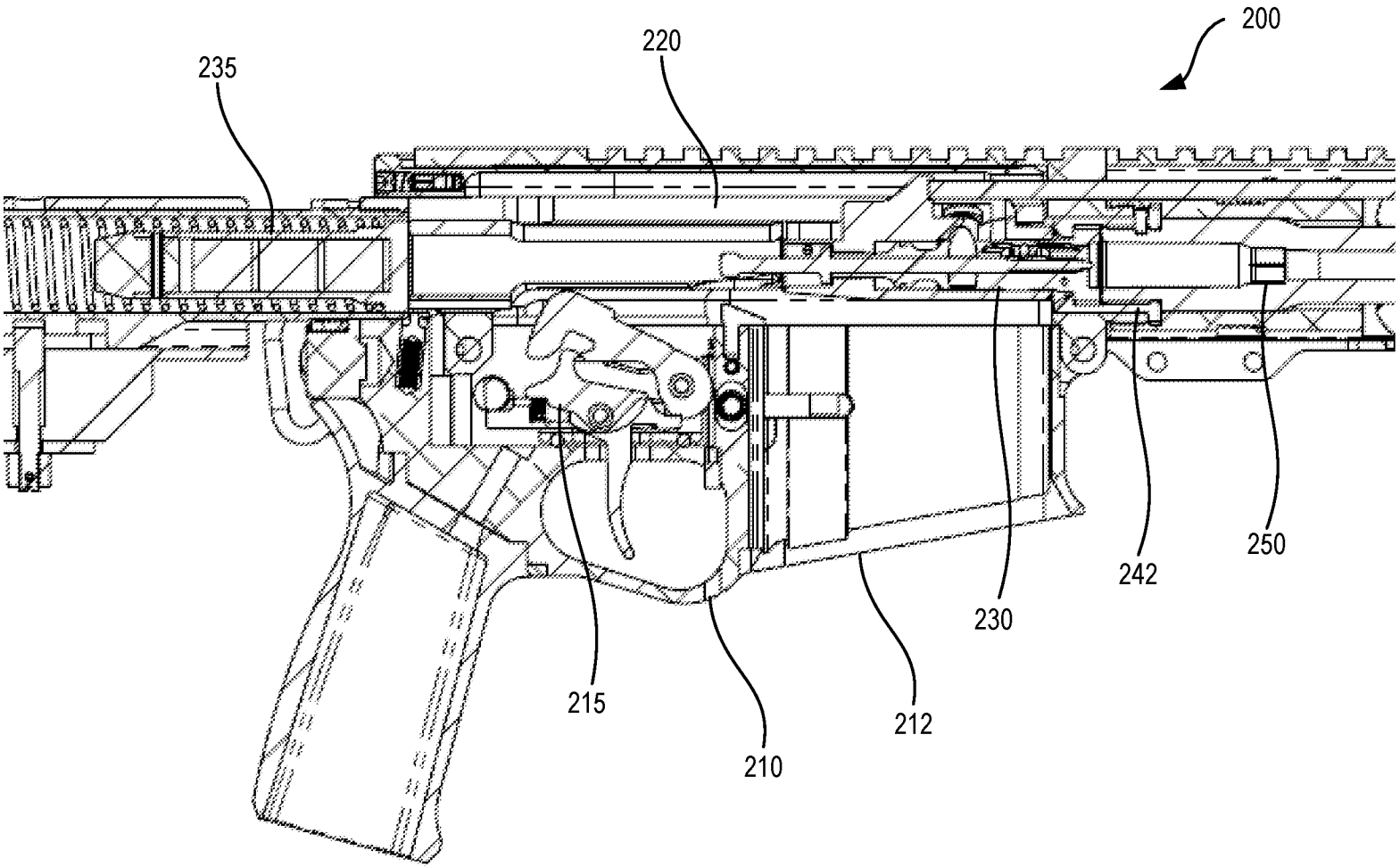
FIG. 2B illustrates an enlarged cross section view of the rifle, in accordance with various embodiments.

In various embodiments and with reference to FIG. 2A and FIG. 2B, a top view of rifle 200 is shown in FIG. 2A, and an enlarged cross section of rifle 200 is shown in FIG. 2B. In various embodiments, rifle 200 may be the same as rifle 100. The stroke or operational travel of rifle 200 may be sufficient to extract and/or load a .308 cartridge. In this regard the overall travel of bolt 230 within upper receiver 220 is substantially further than the travel of a bolt configured to actuate a firearm in .223 cartridge. In various embodiments, the bolt 230 may comprise a delay which slows the cycle rate of the rifle 200. Moreover, buffer system 235 may be configured within elongated stroke as compared to a mil spec rifle to facilitate the operation of rifle 200 and more specifically the travel of bolt 230 within upper receiver 220. As illustrated, the bolt 230 is located within the barrel extension 242. The rifle 200 may comprise grooves 250 in a neck portion of the chamber of the barrel, and the grooves 250 may terminate in the shoulder portion of the chamber. The grooves 250 may assist in extraction of a shell by allowing gas from a fired cartridge to enter the grooves 250 and force the cartridge in an aft direction by applying gas pressure against the shoulder of the cartridge, as well as by compressing the neck of the cartridge.

In various embodiments, lower receiver 210 may be configured differently from a mil spec lower receiver. In this regard trigger assembly 215 may be disposed aft of elongated magazine well 212 to facilitate actuation of bolt 230 in the battery position and receipt of a magazine and associated .308 cartridge. As shown in FIG. 2B, upper receiver 220 may comprise a rear take down pin hole. The rear take down pin hole may have a first diameter. Lower receiver 210 may also have a rear take down pin hole and a selector hole. The rear take down pin of lower receiver 210 may also have a second diameter. The selector hole of lower receiver 210 may also have a third diameter. The first diameter, second diameter and third diameter may be arranged in an overlapping configuration along an axis parallel two A-A, as shown in FIG. 1A. Stated another way, the axis may be perpendicular to the centerline of the barrel extension and/or barrel of firearm 200.

Figure 3B:
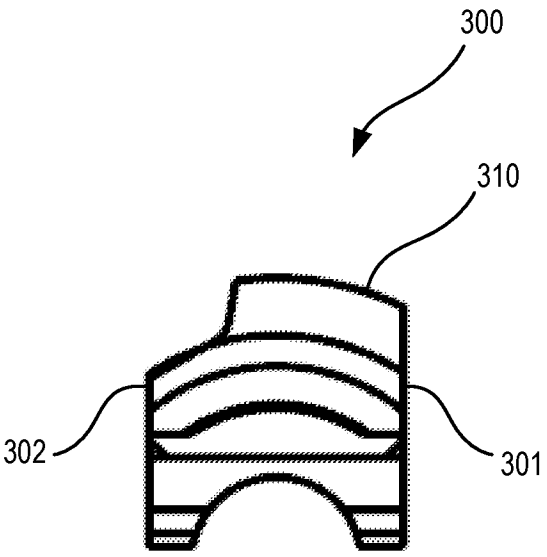
FIG. 3B illustrates a front view of the extractor, in accordance with various embodiments.
Figure 3A:
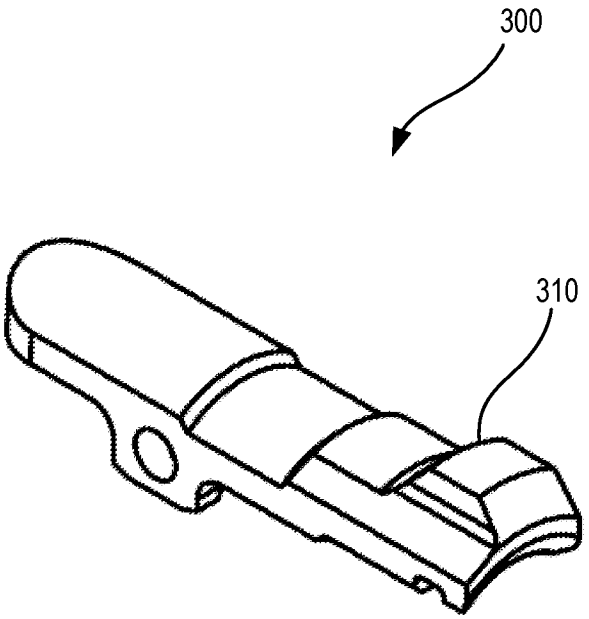
FIG. 3A illustrates a perspective view of an extractor, in accordance with various embodiments.

Referring to FIGS. 3A and 3B, a perspective view, and a forward view of an extractor 300 are illustrated according to various embodiments. The extractor 300 may comprise an extractor lug 310 extending from a first side 301 of an exterior of the extractor 300 and less than a full distance across the extractor 300, such that the extractor lug 310 does not extend to the second side 302 of the extractor 300. The extractor lug 310 may be configured to be located within the extractor gap 147 illustrated in FIG. 1E.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods and systems are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rotating bolt firearm, comprising:
an upper receiver defining a first rear pin hole;
a rear receiver pin having a first diameter;
a lower receiver defining a second rear pin hole and a first selector hole, a selector having a second diameter, the lower receiver coupled to the upper receiver,
wherein the first diameter and the second diameter are arranged in an overlapping configuration along a first axis perpendicular to a centerline of the upper receiver of the firearm;
a barrel coupled to the upper receiver;
a bolt carrier group comprising an extractor;
a barrel extension coupled to the barrel, wherein the barrel extension comprises:
a plurality of lugs spaced around an interior circumference of the barrel extension.

2. The rotating bolt firearm of claim 1, wherein the extractor gap is located in the space disposed between a first lug and a second lug of the plurality of lugs that is larger than the space disposed between each of the other lugs of the plurality of lug.

3. The rotating bolt firearm of claim 1, wherein the extractor gap comprises a 90-degree portion of the barrel extension minus the width of at least one lug of the plurality of lugs.

4. The rotating bolt firearm of claim 3, wherein the barrel extension comprises a plurality of locations spaced around the interior circumference of the barrel extension, wherein a lug of the plurality of lugs is disposed in each of the plurality of locations except one, forming an empty location of the plurality of locations, wherein the extractor gap is located at least partially in the empty location.

5. The rotating bolt firearm of claim 3, wherein the extractor comprises an extractor lug extending from a first side of the extractor, and wherein the extractor lug does not extend to a second side of the extractor.

6. The rotating bolt firearm of claim 1, wherein a weight of the rotating bolt firearm is less than 6.3 pounds.

7. The rotating bolt firearm of claim 1, further comprising grooves in a neck portion of a chamber of the barrel.

8. The rotating bolt firearm of claim 1, wherein the grooves are configured to facilitate extraction of a cartridge.

9. A rotating bolt firearm, comprising:
an upper receiver defining a first rear take down pin hole;
a lower receiver defining a second rear take down pin hole and a selector hole, the lower receiver coupled to the upper receiver,
a selector installable in the lower receiver through the selector hole, the selector having a selector diameter and a selector pin diameter;
a rear takedown pin having a head diameter and a pin diameter;
wherein the selector diameter and the head diameter are arranged in an overlapping configuration along a first axis perpendicular to a centerline of a breach of the firearm;
a barrel coupled to the upper receiver;
a bolt carrier group comprising an extractor;
a barrel extension coupled to the barrel, wherein the barrel extension comprises:
a plurality of lugs spaced around an interior circumference of the barrel extension; and
a feed ramp.

10. The rotating bolt firearm of claim 9, further comprising a magazine well defined in the lower receiver.

11. The rotating bolt firearm of claim 10, wherein the magazine well has an opening of at least 2.80 inches.

12. The rotating bolt firearm of claim 10, wherein the magazine well comprises a finger placement notch.

13. The rotating bolt firearm of claim 9, wherein a weight of the rotating bolt firearm is less than 6.3 pounds.

14. The rotating bolt firearm of claim 9, further comprising grooves in a neck portion of a chamber of the barrel.

15. The rotating bolt firearm of claim 9, wherein the grooves are configured to facilitate extraction of a cartridge.

16. A rotating bolt firearm, comprising:

an upper receiver defining a first rear take down pin hole, the first rear take down pin hole having a first diameter;

a lower receiver defining a second rear take down pin hole and a selector hole, the lower receiver coupled to the upper receiver, the second rear take down pin hole having a second diameter and the selector hole having a third diameter, wherein the first diameter, second diameter and third diameter are arranged in an overlapping configuration along a first axis perpendicular to a centerline of a breach of the firearm;

a selector installable in the lower receiver through the selector hole;

a barrel coupled to the upper receiver;

a bolt carrier group comprising an extractor;

a barrel extension coupled to the barrel, and;

a feed ramp.

17. The rotating bolt firearm of claim 16, further comprising a magazine well defined in the lower receiver.

18. The rotating bolt firearm of claim 17, wherein the magazine well has an opening of at least 2.80 inches.

19. The rotating bolt firearm of claim 17, wherein the magazine well comprises a finger placement notch.

20. The rotating bolt firearm of claim 16, wherein a weight of the rotating bolt firearm is less than 6.3 pounds.

21. The rotating bolt firearm of claim 16, further comprising grooves in a neck portion of a chamber of the barrel.

* * * * *